United States Patent [19]

Schwappach

[11] Patent Number: 4,465,425

[45] Date of Patent: Aug. 14, 1984

[54] DEVICE FOR THE PARAXIAL KINETIC CONTROL OF A LIFTING MACHINE BOOM

[75] Inventor: Dieter Schwappach, Dortmund, Fed. Rep. of Germany

[73] Assignee: O&K Orenstein & Koppel Aktiengesellschaft, Berlin, Fed. Rep. of Germany

[21] Appl. No.: 342,451

[22] Filed: Jan. 25, 1982

[30] Foreign Application Priority Data

Feb. 6, 1981 [DE] Fed. Rep. of Germany ..... 3104072

[51] Int. Cl.[3] ..... E02F 9/20

[52] U.S. Cl. ..... 414/685; 414/712; 414/710; 414/694; 414/550

[58] Field of Search ..... 414/685, 687, 694, 707, 414/710–714, 722, 917, 546, 550; 212/227, 231, 237, 238, 260, 261; 37/117.5, 118, 103

[56] References Cited

U.S. PATENT DOCUMENTS

| | | | |
|---|---|---|---|
| 3,148,789 | 9/1964 | Gourjon | 414/694 |
| 3,370,729 | 2/1968 | Clarke | 414/713 X |
| 3,872,991 | 3/1975 | Pasideris et al. | 414/707 |
| 4,212,404 | 7/1980 | Campbell et al. | 414/694 X |
| 4,329,797 | 5/1982 | Shumaker | 414/685 X |

FOREIGN PATENT DOCUMENTS

| | | | |
|---|---|---|---|
| 930019 | 7/1955 | Fed. Rep. of Germany | 414/685 |

*Primary Examiner*—Robert J. Spar
*Assistant Examiner*—Terrance L. Siemens
*Attorney, Agent, or Firm*—Martin A. Farber

[57] ABSTRACT

A device for the paraxial kinetic control of a boom that can be swivelled perpendicular to the rotatable platform of a mobile lifting machine wherein there is provided at least one coupling rocker which is pivotally mounted on the boom and provides a pivotal connection for a plurality of points of application of force, two points of application of force being linked to the platform of the lifting machine.

33 Claims, 7 Drawing Figures

DEVICE FOR THE PARAXIAL KINETIC CONTROL OF A LIFTING MACHINE BOOM

The invention relates to a device for the paraxial kinetic control of a boom that can be pivoted perpendicular to the rotatable platform of a mobile lifting machine.

The object of the invention is to control the boom of the lifting machine over its pivoting range with a selectably predetermined, for example constant, torque characteristic. A tool is also to be provided with selectably specified guided movement.

In a device of the introductorily mentioned type, one solution to the object is to provide at least one coupling rocker which is pivotally mounted on the boom and has a rigid connection of a plurality of points of application of force, two points of application of force being linked to the platform of the lifting machine.

There is already known from German Offenlegungsschrift No. 2,551,120 a hydraulically operated, self-propelled excavator having a superstructure which can be swivelled about a vertical axis and a boom articulated to the superstructure, which boom is pivotable about a horizontal axis and comprises a basic boom and an arm and has a pivoting bucket at the free end thereof. In the forward third of the basic boom (see FIG. 4), a two-armed rocker is mounted to pivot about an axis, and the end of the rocker facing the superstructure is articulated to the superstructure via a rod.

German Auslegeschrift No. 1,207,279 describes a comparable device.

The arrangements in the above-mentioned literature are fundamentally different from the invention.

A prerequisite for controlling the torque on the boom in accordance with the stated object is a coupling pivotally arranged on the boom, which coupling, relative to its axis of pivoting, has points of application of force which form moments opposing one another, for which purpose those points are linked to the platform of the lifting machine. At least two points of application of force are necessary for the formation of moments opposing one another. This prerequisite for controlling the above-mentioned torque is not satisfied in the arrangements of the prior art. They cannot, therefore, act on a device provided therein which is comparable to a boom to control torque in a predeterminable manner.

The particular advantages of the device according to the invention are as follows:

It is possible to control the torque gradient of the boom over its pivoting range in selectably predetermined curves. In particular, it can be selected to be a constant gradient. This ensures that, once a load has been picked up, it can be raised, with the torque constant, to any height that is possible kinematically, even over the complete pivoting range of the boom. A possibly smaller torque on the boom within its range of pivoting no longer needs to be taken into account. Spurting of the pressure oil out of the cylinder and, therewith, the occurrence of losses is avoided.

Furthermore, the consequence of a constant torque control is movement of the boom at constant angular velocity. This proves especially advantageous for precise work with a tool, for example a load hook.

The development of the invention is possible with the additional arrangement of a movement guidance point on the force coupling, to provide selectively specified guided movements for a tool.

It is thus possible to achieve automatic control of the shovel at a constant angle when raising and lowering the boom. As a result, an automatic limitation of the tilt angle of the shovel is provided when the pivoting cylinder is extended to its furthest extent or relatively far, and (a) material is necessarily prevented from being thrown over the shovel in the event of operating errors, and (b) it is possible to dispense with high, and therefore heavy, rear wall protection against such incidents, resulting in a lighter construction of the tool, and (c) the driver can observe the filling operation of the tool and also its movement better.

Emptying of the tool by tipping is accomplished more rapidly since because the angle is constant, it is guided in the tipping direction.

Schematic embodiments of the invention will be described with reference to the drawings.

The drawings show a device for the paraxial kinetic control of a boom that can be pivoted perpendicularly to the rotatable platform of a mobile lifting machine. In this context, the term "paraxial" makes it clear that all the pivotal axes of the kinetic control lie parallel to one another. The other term used, "coupling rocker", indicates the coupling of forces and movements in a member similar to a rocker arm. Comparable parts in the individual drawings are provided with the same numbers. In the drawings.

Figure 1:
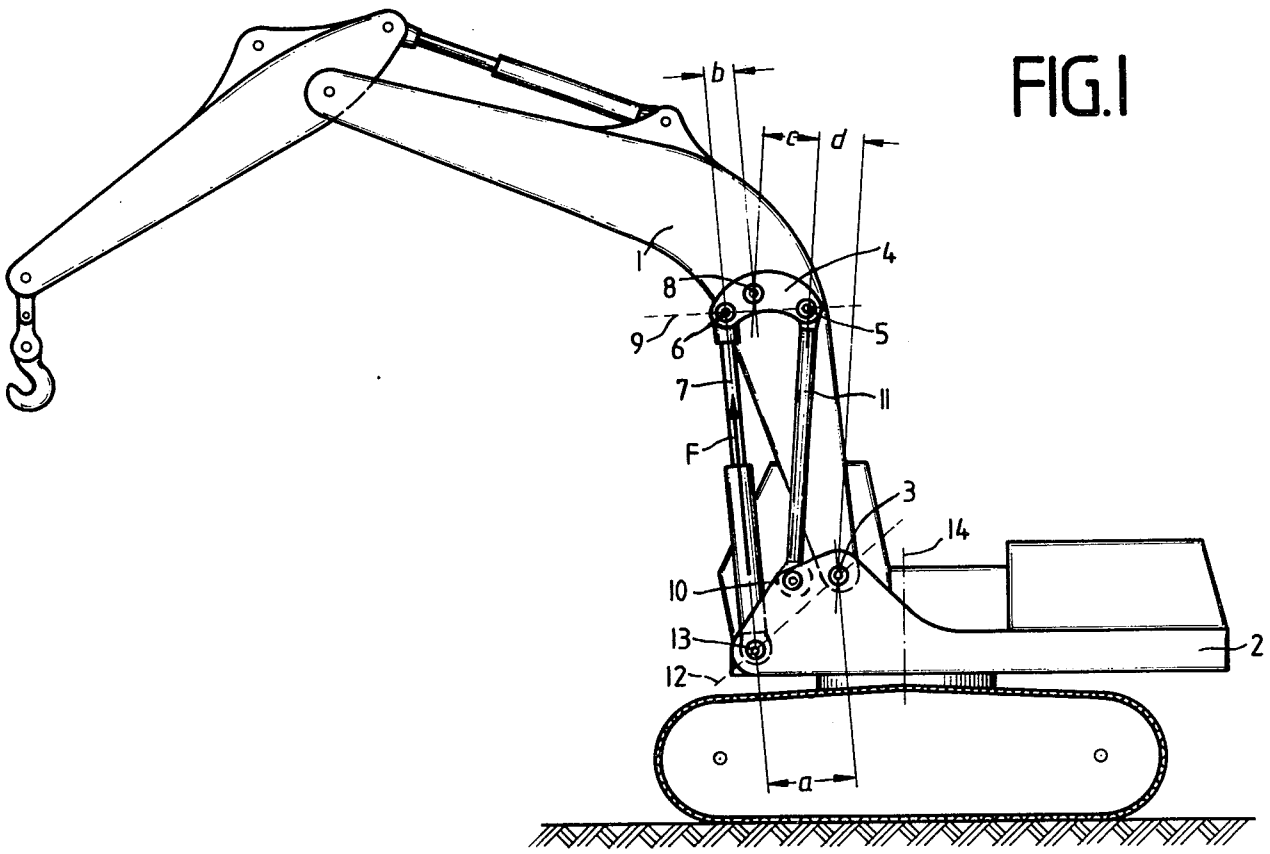
FIG. 1 shows the invention with a biaxial coupling rocker.

In FIG. 1, the mobile lifting machine is illustrated by an excavator having a load hook.

The boom 1 is connected to the platform 2 at the boom axis 3. Pivotally mounted on the boom 1 is the coupling rocker 4 which provides a pivotal connection of a plurality of points 5 and 6 of application of force. One point 5 of application of force is linked to the platform 2 of the lifting machine such that its distance from the platform does not vary and the other point 6 of application of force is linked to the platform 2 of the lifting machine by a variable-length adjusting member 7. It can be seen from the Figure that the position of the pivotal axis 8 of the coupling rocker 4 is so selected that the projection thereof taken perpendicularly to a line 9 connecting the two points 5 and 6 for the application of force falls between those points, and the pivotal axis 8 of the coupling rocker 4 is arranged above the connecting line 9 in the longitudinal direction of the boom. In a similar manner, the perpendicular projection of the pivotal axis 10 of the invariable-length link 11 lies on a connecting plane 12 between the boom axis 3 and the pivotal axis 13 of the variable-length adjusting member 7 and between those axes. The pivotal axis 10 similarly lies above the connecting plane 12 in the longitudinal direction of the boom. The arrangement in this case is so chosen that the pivotal axis 10 lies spatially closer to the swivel axis 14 of the platform 2 than does the pivotal axis 13. The center lines of the invariable length link 11 and of the variable-length adjusting member 7 do not intersect in the region between the coupling rocker 4 and the platform 2. As shown, the coupling rocker 4 consists of a one-piece member, preferably constructed in one plane. The variable-length adjusting member 7 is in the form of a hydraulic cylinder and the invariable-length link 11 is in the form of a rod.

Figure 7:
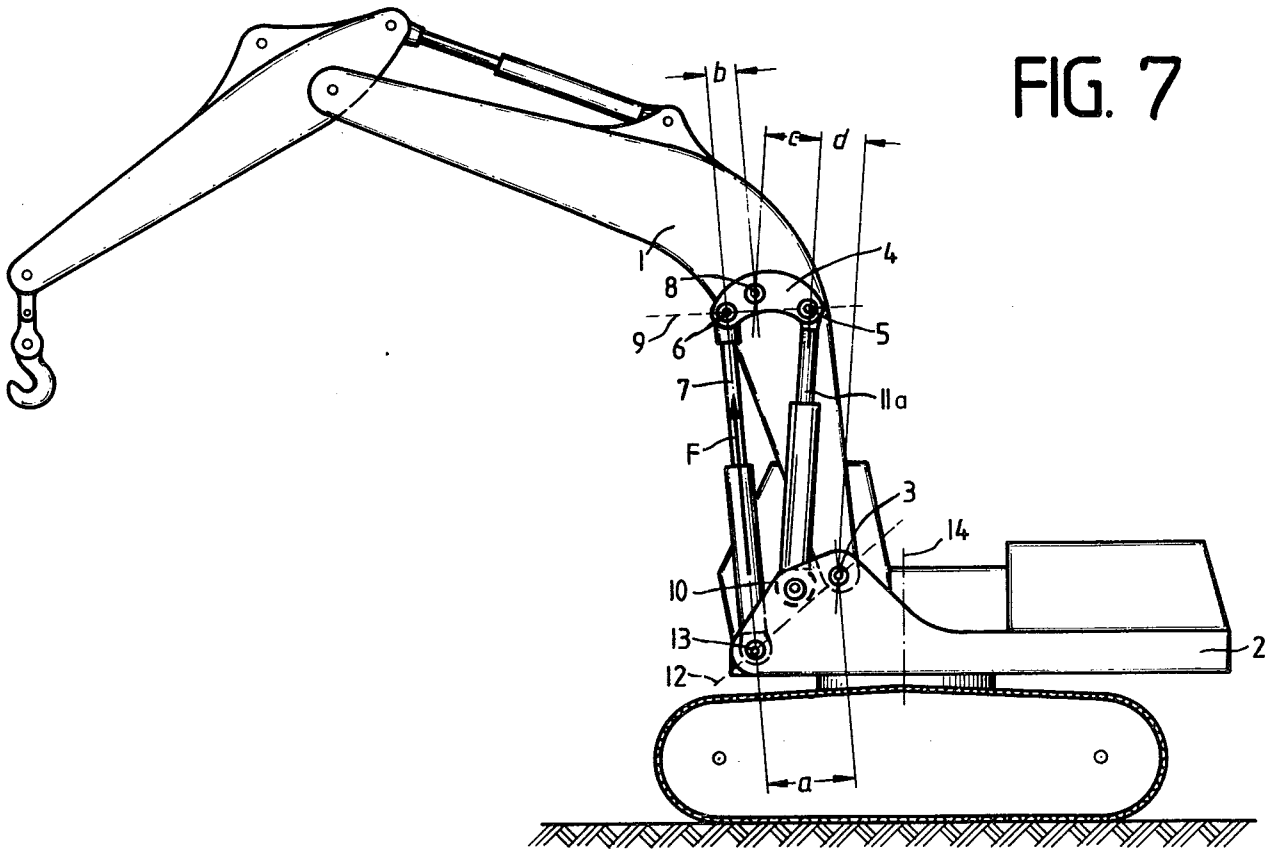
FIG. 7 is a view as FIG. 1 but showing another embodiment of the invention.

The invariable-length link 11 mentioned above can be replaced by a short-stroke cylinder 11*a* (FIG. 7) in a special construction of the invention when great pulling free forces are necessary for a lifting machine.

In a method of operating the device shown, it is possible to obtain torque control in selectably predetermined curves for the boom 1. For this purpose, an active force F is introduced into the system shown by the variable-length adjusting member 7. This produces, via the coupling rocker 4, a reaction force in the invariable-length link 11 which is a function of the active force F. More precisely, the reaction force is determined by the magnitude of the active force F of the variable-length adjusting member 7 times its shortest distance b to the pivotal axis 8 of the coupling rocker 4, divided by the shortest distance c of the directional line of the invariable-length link 11 and the pivotal axis 8.

It can be said, therefore, that the reaction force is determined as follows:

$$\text{reaction force} = (F \times b/c).$$

The moment M about the boom axis 3 is made up of the moment: active force F of the variable-length adjusting member 7 times its shortest distance a to the boom axis 3, and of the moment: reaction force of the invariable-length link 11 times its shortest distance d to the boom axis 3.

The following therefore applies for the moment:

$$M = F \times a + (F \times b \times d)/c.$$

Starting from given constructional locations for the boom axis 3, link pivotal axis 10 and pivotal axis 13 of the adjusting member on the platform 2, by means of selection of the position of the points 5 and 6 for the application of force in their relation to the pivotal axis 8 of the coupling rocker 4, the torque gradient of the boom 1 over its pivoting range can be controlled to selectably predetermined curves. In particular, in an advantageous arrangement of the invention, by selecting the above-mentioned points with regard to their position relative to one another, it is possible to obtain a constant moment on the boom axis 3 either for part of or for the entire pivoting range of the boom 1.

Figure 2:
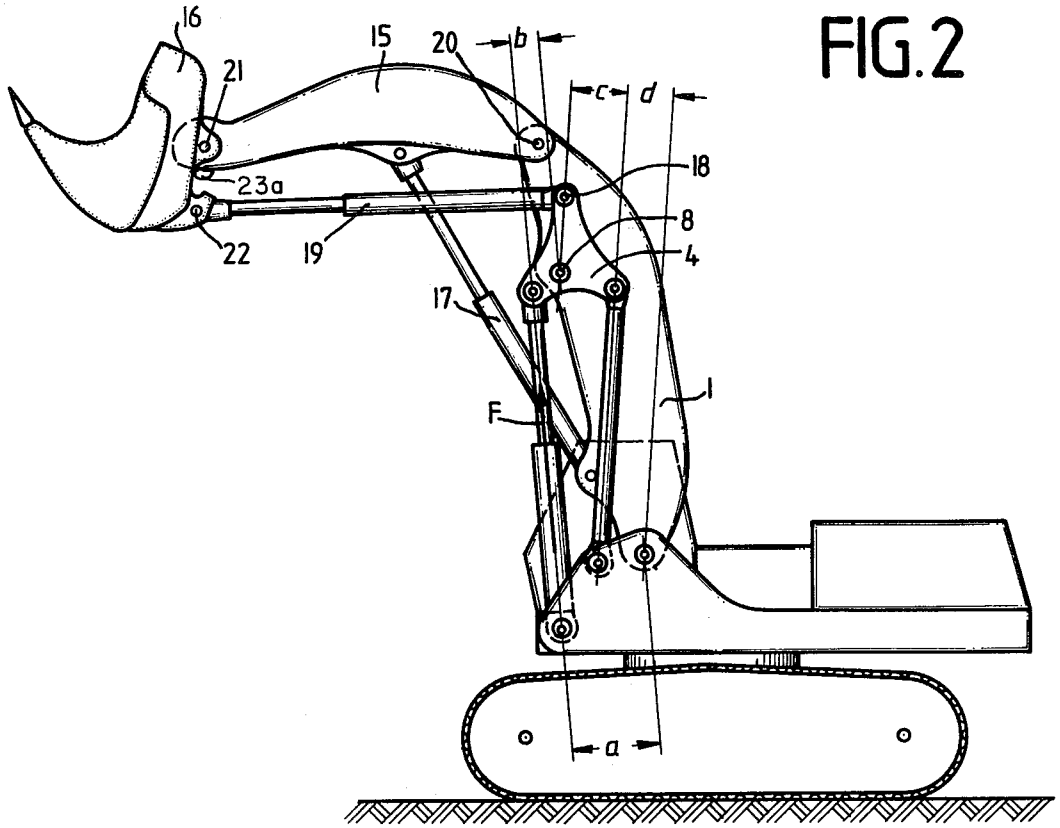
FIG. 2 shows a development of the invention with a triaxial coupling rocker.

FIG. 2 shows a development of the invention in an excavator fitted with a shovel.

Pivotably mounted to the upper part of the boom is the arm 15 on which a tool 16 is articulated. A pivoting cylinder 17 is pivotally connected between the boom 1 and the arm 15. In this construction, the coupling rocker 4 has an additional movement guidance point 18 which is connected to the tool 16 by means of a tool adjusting member 19 which may be, for example, a hydraulic cylinder. The additional movement guidance point 18 forms a corner point of an approximate parallelogram oriented in the longitudinal direction of the arm and defined by the connection to, or between, the further points:

common pivot 20 of the boom and the arm,
common pivot 21 of the arm and the tool, and
common pivot 22 of the tool and the work adjusting member.

The additional movement guidance point 18 is provided on the coupling rocker 4 above the pivoting axis 8 of the rocker in the longitudinal direction of the boom.

Figure 3:
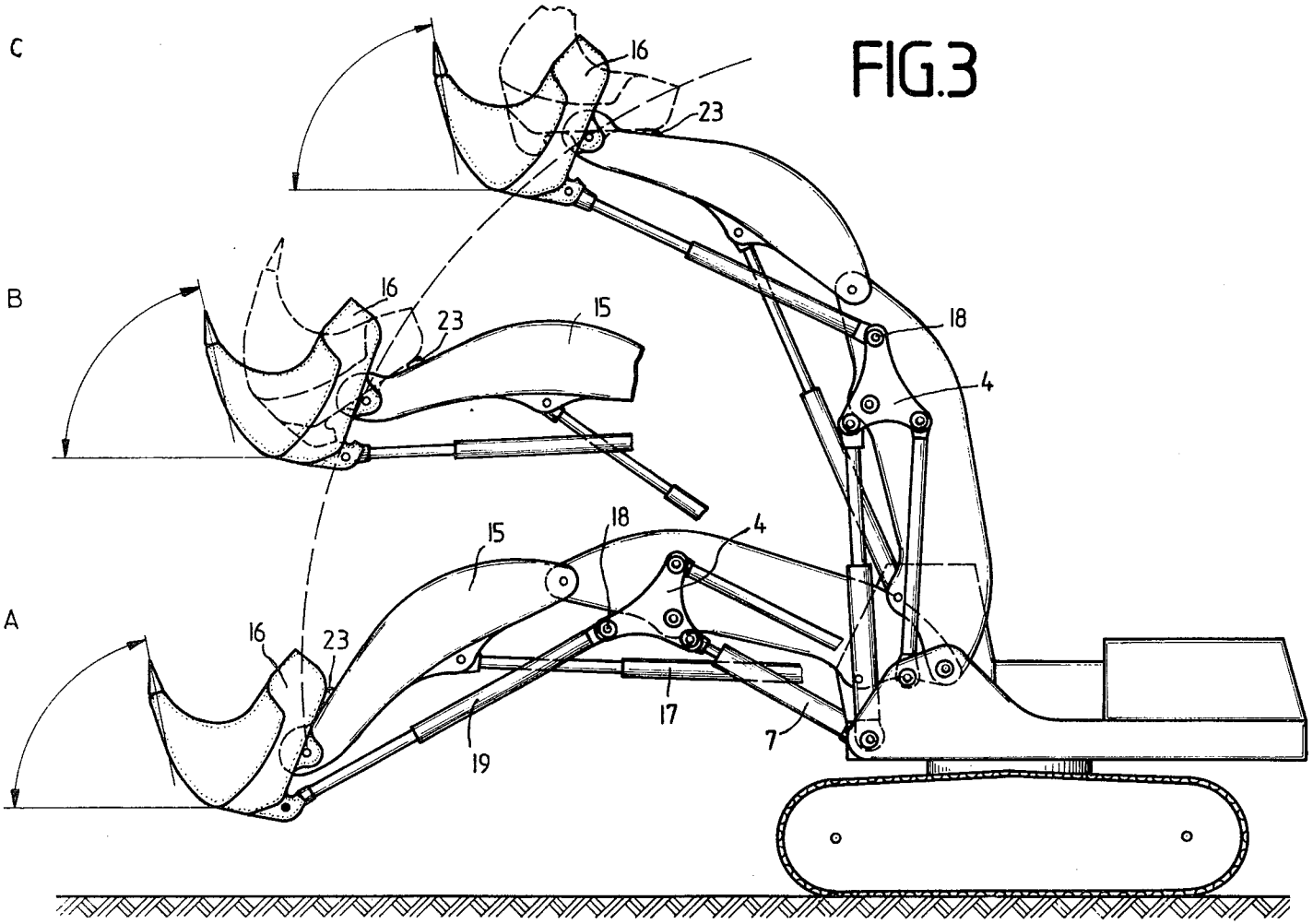
FIG. 3 shows a lifting operation that is of constant angle for the tool.

In FIG. 3, it can be seen that, in position A of the boom 1 and of the arm 15, the maximum length of the tool adjusting member 19 is so calculated that, at the shortest length of the variable-length adjusting member 7 and the greatest length of the pivoting cylinder 17, the tool 16 rests in its end pivoted position against a stop 23 on the upperside of the arm 15. The fixed minimum length of the tool adjusting member 19 at the shortest length of the variable-length adjusting member 7 and at the greatest length of the pivoting cylinder 17 guides the tool 16 into its other end pivoted position against a stop 23*a* on the underside of the arm (FIG. 2).

Positions B and C in FIG. 3 further show that, when the working length of only the variable-length adjusting member 7 is altered, an assumed coordinate system in the center of gravity of the tool 16 is moved at constant angle relative to a likewise imaginary parallel coordinate system in the boom axis 3 as far as the end pivoted position of the tool 16.

By way of contrast, positions B and C of the drawing also show, in each case by broken lines of the tool, that in the arrangements of the prior art, the tool remains against the stop 23 on the upperside of the arm 15 giving rise to the danger of the load being tipped onto the roof of the excavator unless the excavator operator adjusts the tool adjusting member 19 or the latter is adjusted automatically. In the last-mentioned case, as a result of an incorrect operation of the tool adjusting member, injury cannot be ruled out. This disadvantage is reliably avoided with this invention by virtue of the specified maximum length of the tool adjusting member 19 described earlier. Rather, without any adjustment of the tool adjusting member 19, the tool is raised in a specified attitude of constant angle. The reason for this lies in the movement of the additional movement guidance point 18 of the coupling rocker 4 that, in this case, is triaxial.

Figure 4:
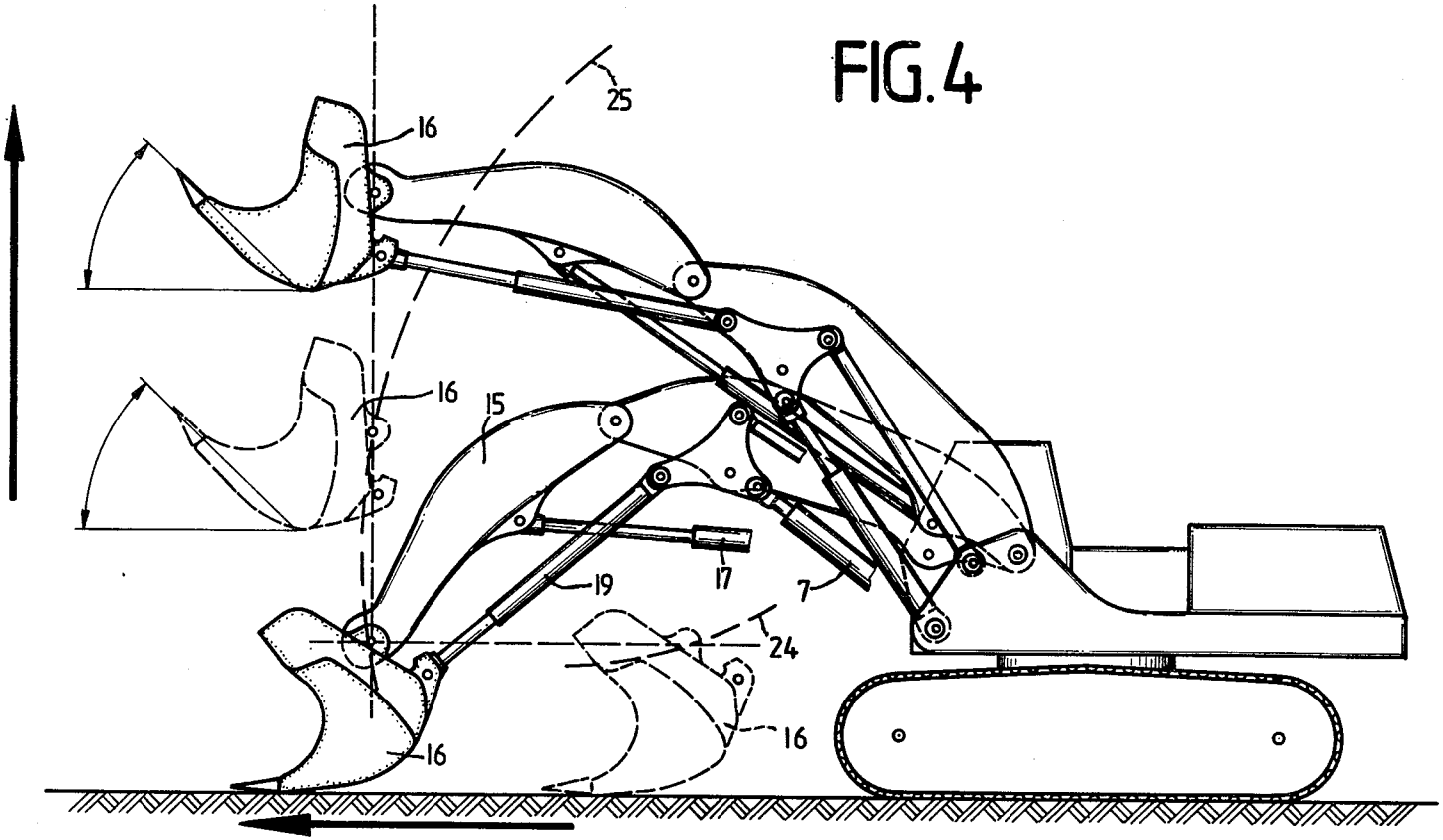
FIG. 4 shows parallel kinematic movements of the tool.

FIG. 4 of the drawings shows the kinematic operation of the tool of an excavator using the coupling rocker according to the invention and involving, on the one hand, the frequent operation of advancing the tool parallel to the working plane and, on the other hand, the case of lifting the tool perpendicular to the working plane.

Assuming a coordinate system in the center of gravity of the tool and setting this in relation to a parallel coordinate system in the boom axis, it will be apparent that, starting from the working position in which the tool is placed on the working plane as close as possible to the excavator, by altering the working length of only the pivoting cylinder 17, the tool 16 would follow a line 24 with the angle of the two coordinate systems relative to each other remaining the same and with the final limits of the movement at the end pivoted positions, with the tool against the upper or lower stop arm.

In order to ensure that the tool 16 remains at the level of the working plane, however, it is also necessary actively to control the variable-length adjusting member 7, so that the tool 16 then moves not only with a constant angle of the two above-mentioned coordinate systems to each other being maintained but also in the direction of only one coordinate of both systems. Such active control of the variable-length adjusting member 7 can easily be carried out with electronic means.

It is possible to compare lifting of the tool 16 perpendicular to the working plane. As was already clear from FIG. 3, in the case of a change in the working length of only the variable-length adjusting member 7, a coordinate system in the center of gravity of the tool would maintain a constant angle relative to the coordinate system in the boom axis 3 and the tool would follow a path indicated by the curve 25. The length of the tool adjusting member 19 meanwhile remains constant. In this case also, the constant angle of the coordinate systems to each other would be limited only by the end pivoted position of the tool 16. If, in addition, the direction of movement of the tool is to be solely perpendicular to the working plane, then the working length of the pivoting cylinder 17 has to be actively controlled, so that not only is the constant angle of the two coordinate systems automatically ensured by the coupling rocker according to the invention in cooperation with the tool adjusting member 19, but also the direction of movement of the tool is only in the direction of one coordinate of the coordinate system.

Figure 5:
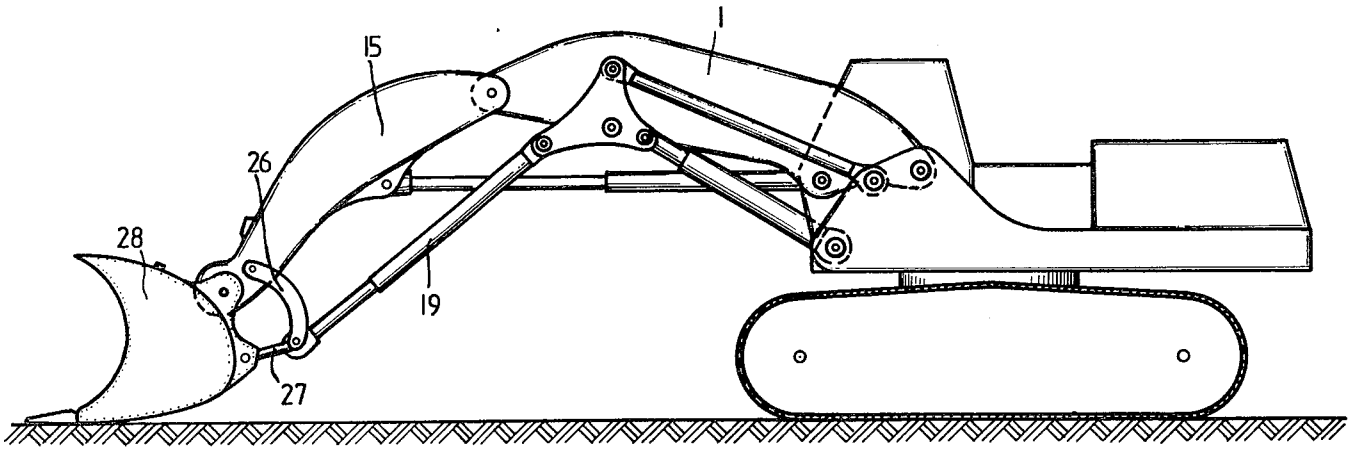
FIG. 5 shows the use of another tool.

FIG. 5 illustrates that the tool 16 shown in the preceding Figures, which has a hinged shovel, can also be replaced by a tipping shovel 28 by way of a connecting rod 27 and a rocker 26. Advantageously, it is even possible in this case, with the above-mentioned fixed dimensions of the tool adjusting member 19, to obtain a larger pivoting range for that type of tool. All connections of 26 and 27 are pivotal.

Figure 6:
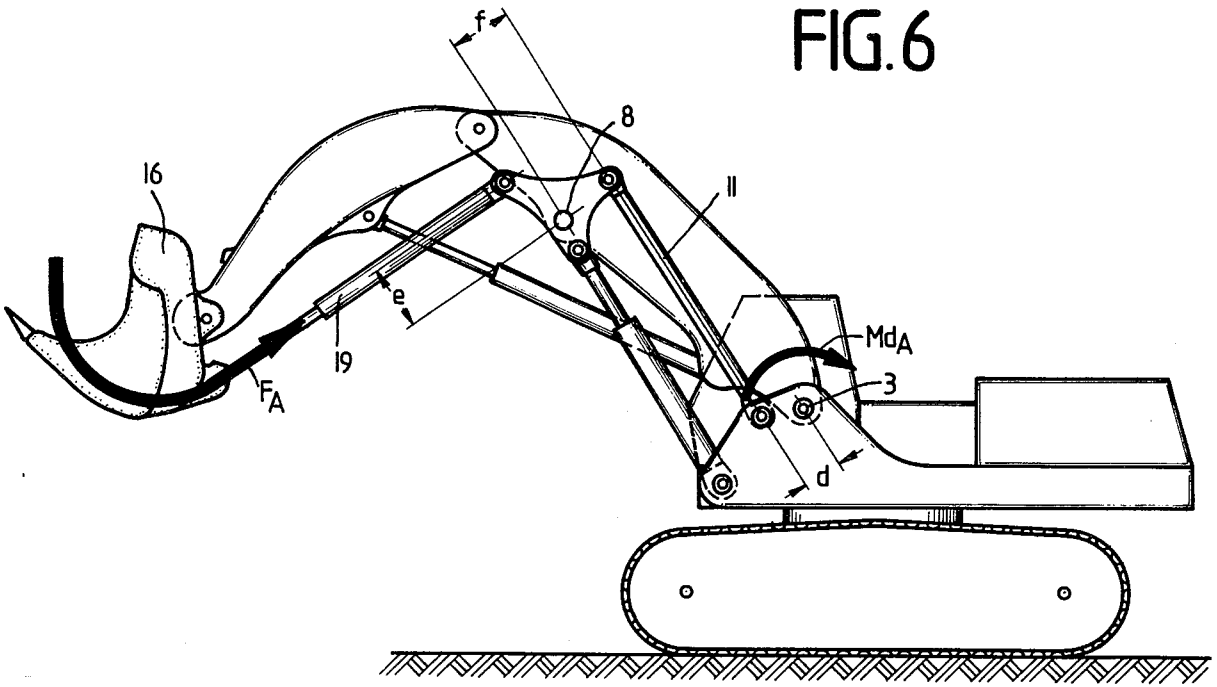
FIG. 6 shows the occurrence of an additional moment on the axis of the boom.

FIG. 6 illustrates the occurrence of an additional moment on the boom axis.

I claim:

1. A device for dynamic control of a boom that is pivotable about a boom axis spaced from and perpendicular relative to a swivel axis of rotation of a rotatable platform of a mobile excavator or lifting machine, comprising at least one coupling rocker being pivotally mounted, at a pivotal axis, on the boom and constituting means for providing a pivotal connection for a plurality of points of application of force thereat, two link means for respectively pivotally connecting two of said points of application of force to the platform said two points being on opposite sides of said pivotal axis, at least one of said link means being a variable-length link means, a pivot axis on said platform of the other link means being located between said boom axis and a pivot axis on said platform of said variable-length link means, whereby the torque gradient of the boom with respect to the pivoting of said boom about said boom axis is controllable over its range of pivoting about said boom axis in a selectably predetermined curve depending on the position of said points of application of force with respect to said pivotal axis.

2. The device according to claim 1, wherein the other of said two link means is an invariable-length link means for linking one of said two points of application of force to the platform such that the distance of said one point from said pivot axis on said platform of said other link means is invariable.

3. The device according to claim 2, wherein the pivotol axis of said coupling rocker on the boom is located such that an imaginary projection thereof taken perpendicularly onto an imaginary line between the two points of application of force is between said two points.

4. The device according to claim 3, wherein said pivotal axis of said coupling rocker is located beyond the line between said two points of application of force in a longitudinal direction of the boom.

5. The device according to claim 2, wherein said pivot axis on said platform of the other link means is located such that an imaginary projection therefrom perpendicularly onto an imaginary connecting plane between the boom axis and said pivot axis on said platform of the variable-length link means lies between said boom axis and said pivot axis on said platform of the variable-length link means.

6. The device according to claim 5, wherein said pivot axis on said platform of the other link means is located above said connecting plane between the boom axis and said pivot axis on said platform of the variable-length link means.

7. The device according to claim 2, wherein said variable-length link means is a hydraulic cylinder.

8. The device according to claim 2, wherein said invariable-length link means is a rod.

9. The device according to claim 1, wherein said pivot axis on said platform of the other link means is located spatially closer to the swivel axis of the platform than said pivot axis on said platform of the variable-length link means, said two link means define longitudinal center lines respectively which do not intersect in a region between the coupling rocker and the platform.

10. The device according to claim 1, wherein said coupling rocker is a one-piece member.

11. The device according to claim 10, wherein said one-piece member is in one plane.

12. The device according to claim 1, wherein said other link means is of variable length.

13. The device according to claim 12, wherein said other link means is a short-stroke cylinder.

14. The device according to claim 1, wherein said variable-length link means is a force actuator for transmitting a force F to one of said points, such that the moment M about the boom axis is $$M=F\times a+F\times b\times d/c$$

where a is the shortest distance from a longitudinal axis of said force actuator to the boom axis, b is the shortest distance from the longitudinal axis of said force actuator to said pivotal axis, c is the shortest distance from a longitudinal axis of the other of said link means to said pivotal axis, and d is the shortest distance from the longitudinal axis of said other link means to said boom axis.

15. A device for paraxial kinetic control of a boom that is pivotable about a boom axis spaced from and perpendicular relative to a swivel axis of rotation of a rotatable platform of a mobile lifting machine, comprising at least one coupling rocker being pivotally mounted, at a pivotal axis, on the boom and constituting means for providing a pivotal rigid connection for a plurality of points of application of force thereat, two of said points of application of force being linked to the platform of the lifting machine, an arm pivotally mounted on an upper part of the boom, a pivoting tool is pivoted on said arm, a pivoting cylinder is fastened between said boom and said arm, said coupling rocker has an additional movement guidance point constituting another of said plurality of points of application of force, a tool adjusting means for operatively connecting said movement guidance point to said pivoting tool.

16. The device according to claim 15, wherein said tool adjusting means is a hydraulic cylinder.

17. The device according to claim 15, wherein said movement guidance point forms a corner point of an approximate parallelogram, the latter being lengthwise oriented in a longitudinal direction of said arm and being further defined between a common pivot of the boom and the arm, a common pivot point of said arm and said tool, and a common pivot point of said tool to said tool adjusting means.

18. The device according to claim 17, wherein said movement guidance point is located on said coupling rocker beyond the pivotal axis of said rocker in the longitudinal direction of the boom.

19. The device according to claim 18, further comrpising an invariable-length link means for linking one of said two points of application of force to the platform of the lifting machine is connected to the platform at a pivotal axis of the invariable-length link means, a variable-length adjusting means for linking the other of said two points of application of force to the platform of the lifting machine is connected to the platform at a pivotal axis of said variable-length adjusting means, a stop is formed on an upper-side of said arm, said pivoting tool is guided into an end pivoted position thereof against said stop on the upper-side of said arm at a maximum length of said tool adjusting means, at a shortest length of said variable-length adjusting means and at a greatest length of said pivoting cylinder between said boom and said arm.

20. The device according to claim 17 further comprising an invariable-length link means for linking one of said two points of application of force to the platform of the linking machine is connected to the platform at a pivotal axis of the invariable-length link means, a variable-length adjusting means for linking the other of said two points of application of force to the platform of the lifting machine is connected to the platform at a pivotal axis of said variable-length adjusting means, a stop is formed on an under-side of said arm, said pivoting tool is guided into an end pivoted position thereof against said stop on the under-side of said arm at a minimum length of the tool adjusting means, at a shortest length of said variable-length adjusting means and at a greatest length of said pivoting cylinder between said boom and said arm.

21. The device according to claim 15, further comprising a connecting rod and another rocker which operatively connect said tool adjusting means to said pivoting tool, the latter constituting a tipping shovel.

22. A method for operating a device having a torque control of a boom for paraxial kinetic control of the boom that is pivotable about a boom axis spaced from and perpendicular relative to a swivel axis of rotation of a rotatable platform of a mobile excavator or lifting machine comprising at least one coupling rocker being pivotally mounted, at a pivotal axis, on the boom and constituting means for providing a pivotal connection for a plurality of points of application of force, two link means for respectively pivotally connecting two of said points of application of force to the platform, said two points being on opposite sides of said pivotal axis, one of said link means being a variable-length link means, a pivot axis on said platform of the other link means being located between said boom axis and a pivot axis on said platform of said variable-length means, the other link means being an invariable-length link means for linking one of said two points of application of force to the platform, said variable-length link means for linking the other of said two points of application of force to the platform, comprising the step of introducing an active force F into the device by said variable-length link means.

23. The method according to claim 22, further comprising producing a reaction force in the device by said invariable-length link means between the coupling rocker and the platform, said reaction force being a function of said active force F of said variable-length link means.

24. The method according to claim 23, wherein said reaction force is determined by the magnitude of said active force F of said variable-length link means times a shortest distance (b) from a longitudinal axis thereof to the pivotal axis of the coupling rocker divided by a shortest distance (c) of a longitudinal axis of said invariable-length link means to the pivotal axis of the coupling rocker, namely:

$$\text{said reaction force} = F = b/c.$$

25. The method according to claim 24, wherein a torque moment M working on said boom equals the sum of the moment, force (F) of said variable-length link means times a shortest distance (a) from the longitudinal axis thereof to the boom axis and the moment, reaction force of said invariable-length link means times a shortest distance (d) of the longitudinal axis thereof to the boom axis, namely:

$$M = F \times a + F \times b \times d/c.$$

26. The method according to claim 25, further comprising the step of starting from given locations of: the boom axis, said pivot axis on said platform of the invariable-length link means and said pivot axis on said platform of the variable-length link means, selectively controlling torque gradient of the boom with respect to the pivoting of said boom about said boom axis over its pivoting range about said boom axis in selectably predetermined curves by means of the positions of said two points of application of force in their relation to the pivotal axis of the coupling rocker.

27. The method according to claim 26, further comprising controlling constant the moment on the boom axis for at least a portion of the entire pivoting range of the boom.

28. The method according to claim 27, wherein the moment on the boom axis is constantly controlled for the entire pivoting range of the boom.

29. A process for operating a device for paraxial kinetic control of a boom that is pivotable about a boom axis spaced from and perpendicular relative to a swivel axis of rotation of a rotatable platform of a mobile lifting machine, comprising at least one coupling rocker being pivotally mounted, at a pivotal axis, on the boom and constituting means for providing a pivotal rigid connection for a plurality of points of application of force thereat, two of said points of application of force being linked to the platform of the lifting machine, an invariable-length link means for linking one of said two points of application of force to the platform of the lifting machine, a variable-length adjusting means for linking the other of said two points of application of force to the platform of the lifting machine, an arm is pivotally mounted on an upper part of the boom, a pivoting tool is pivoted on said arm, a pivoting cylinder is fastened between said boom and said arm, said coupling rocker has an additional movement guidance point constituting another of said plurality of points of application of force, a tool adjusting means connects said movement guidance point to said pivoting tool, comprising the step of altering the working length of only said pivoting cylinder, whereby a coordinate system in the center of gravity of the tool is moved at a constant angle relative to a parallel coordinate system in the boom axis as far as an end pivoted position of the tool.

30. The process according to claim 29, wherein while the working length of said pivoting cylinder is altered, actively controlling said variable-length adjusting means in such a manner that said center of gravity coordinate system is moved only in translation.

31. The process for operating a device for paraxial kinetic control of a boom which is pivotable about a boom axis spaced from and perpendicular relative to a swivel axis of rotation of a rotatable platform of a mobile lifting machine, comprising at least one coupling rocker being pivotally mounted, at a pivotal axis, on the boom and constituting means for providing a pivotal rigid connection for a plurality of points of application of force thereat, two of said points of application of force being linked to the platform of the lifting machine, an invariable-length link means for linking one of said two points of application of force to the platform of the lifting machine, a variable-length adjusting means for linking the other of said two points of application of force to the platform of the lifting machine, an arm is pivotally mounted on an upper part of the boom, a pivoting tool is pivoted on said arm, a pivoting cylinder is fastened between said boom and said arm, said coupling rocker has an additional movement guidance point constituting another of said plurality of points of application of force, a tool adjusting means connects said movement guidance point to said pivoting tool, comprising the step of altering the working length of only said pivoting cylinder, whereby a coordinate system in the center of gravity of the tool is moved at a constant angle relative to a parallel coordinate system in the boom axis as far as an end pivoted position of the tool.

32. The process according to claim 31, wherein while the working length of said variable-length adjusting means is altered, actively controlling said pivoting cylinder in such a manner that said center of gravity coordinate system is moved only in translation.

33. A device for dynamic control of a boom that is pivotable about a boom axis spaced from and perpendicular relative to a swivel axis of rotation of a rotatable platform of a mobile excavator or lifting machine, comprising at least one coupling rocker being pivotally mounted, at a pivotal axis, on the boom and constituting means for providing a pivotal connection for a plurality of points of application of force thereat, two of said points of application of force being linked to the platform of the lifting machine, said two points being on opposite sides of said pivotal axis, a short-stroke cylinder means for linking one of said two points of application of force to the platform, and a variable-length adjusting means for linking the other of said two points of application of force to the platform, whereby the torque gradient of the boom with respect to the pivoting of said boom about said boom axis is controllable over its pivoting range about said boom axis in a selectably predetermined curve.

* * * * *